US005311394A

United States Patent [19]

Naab et al.

[11] Patent Number: 5,311,394

[45] Date of Patent: May 10, 1994

[54] WATER-ACTUATED PRESSURIZED GAS RELEASE DEVICE

[75] Inventors: Carlton W. Naab; Francis M. Miller, both of Clearwater, Fla.

[73] Assignee: Conax Florida Corporation, St. Petersburg, Fla.

[21] Appl. No.: 957,950

[22] Filed: Oct. 7, 1992

[51] Int. Cl.[5] ..... B63C 9/08

[52] U.S. Cl. ..... 361/248; 222/5; 441/93

[58] Field of Search ..... 441/80, 88, 92, 93, 441/94, 95, 96, 97, 98; 361/247, 248, 251; 102/200, 200.5, 200.9, 200.12, 200.14; 222/5

[56] References Cited

U.S. PATENT DOCUMENTS

| | | | |
|---|---|---|---|
| 3,426,942 | 2/1969 | McMains et al. | 222/5 |
| 4,024,440 | 5/1977 | Miller | 361/251 |
| 4,768,128 | 8/1988 | Jankowiak et al. | 361/251 |
| 4,927,057 | 5/1990 | Janko et al. | 222/5 |
| 5,035,345 | 7/1991 | Janko et al. | 222/5 |
| 5,148,346 | 9/1992 | Naab et al. | 361/251 |

*Primary Examiner*—Jeffrey A. Gaffin

*Attorney, Agent, or Firm*—Hodgson, Russ, Andrews, Woods & Goodyear

[57] ABSTRACT

A water-actuated, pressurized gas release device (10) that automatically actuates to inflate an associated personal flotation device when immersed in an electrically conductive fluid, such as salt or fresh water, is described. The device is comprised of a high strength plastic housing (12) that holds an enclosure tube (62) housing a primer charge (68) in a longitudinal alignment with a piercing pin (44). The primer is connected to a lever (80) and a lead wire (84) that is electrically connected to an electrical circuit means (87) which is in electrical contact with a pair of batteries (118A, 118B). When the device is immersed in water, an electrical circuit is formed between a terminal (122) of the battery pack and the lever and lead wire which serve as an electrical return to the electrical circuit means. This ignites the primer which creates explosive propulsion gases that drive a lance portion (46) of the piercing pin into a puncturable closure member (32) of a gas container (30) to inflate the personal flotation device. A conformal coating prevents the water from short circuiting the electrical circuit means until after the primer has been ignited. The gas container can also be manually punctured by actuating the lever which cams against the enclosure tube which moves against the piercing pin to drive the lance into the puncturable closure.

23 Claims, 2 Drawing Sheets

WATER-ACTUATED PRESSURIZED GAS RELEASE DEVICE

The present invention relates to a device suitable for general commercial and individual recreational use that is automatically actuated to release gas from a pressurized gas cylinder when immersed in an electrically conductive fluid. In particular, the pressurized gas release device of the present invention has a relatively small size and is of a lightweight construction that does not hinder a person moving about. That way, the device can be worn on a belt or otherwise secured to a person's body as a personal effect and serves to automatically inflate a personal flotation device should the person inadvertantly fall into fresh or salt water. The personal flotation device can be a life jacket, a life vest or a personal life raft. The potentially life-threatening drowning situation is thereby averted.

The device has a housing made of a high strength plastic material. The housing provides for mounting a pressurized gas container closed by a puncturable member in communication with a longitudinally extending piercing pin bore. This bore has a piercing pin that is sealed inside the bore but is able to move axially along the bore. The piercing pin has a lance end facing the puncturable member of the gas container, an intermediate section in a sealed relationship with the piercing pin bore and a distal end. The distal end of the piercing pin mates with the open end of a tubular-shaped enclosure. The enclosure is closed at its other end and houses a primer charge mounted longitudinally along the axis of the piercing pin bore. The primer charge is connected to an electrical circuit means that is in turn connected to one terminal of a battery pack. A remote battery terminal is insulated from the housing. That way, when the device is immersed in an electrically conductive fluid, such as salt or fresh water, an electrical circuit path is established between the remote battery terminal and a return mounted on the housing for the electrical circuit means. This creates a current which fires the primer. The primer then creates explosive propulsion gases that are channeled and directed longitudinally along the axis to move the piercing pin along the piercing pin bore to cause the lance to puncture the puncturable member of the pressurized gas container. The pressurized gas then is able to inflate the associated personal flotation device.

Aligning the primer charge longitudinally along the axis of the piercing pin bore provides an efficient design that enables the device to be compact and have an unobstrusive size for use by non-military users. A conformal coating on the electrical circuit means prevents the electrical circuit from short circuiting long enough for the electrical current path to establish and fire the primer. In the automatic mode, the device is not reusable, but is intended as a "throw-away". The device can also be manually actuated in which case it can be reused.

PRIOR ART

U.S. Pat. Nos. 4,024,440 to Miller and 4,768,128 to Jankowiak et al, which are assigned to the assignee of the present invention and are incorporated herein by reference, describe water-actuated, pressurized gas release devices for inflating flotation equipment, such as life vests that are adapted for use by pilots and seamen. These devices work well because they are easily worn by a pilot or by a seaman working around water. This ensures that the device will be available should the pilot ever be forced to abandon his airplane or should the seaman ever fall overboard from a ship. Then, the device will automatically actuate to inflate a flotation device and help save the pilot's or seaman's life.

U.S. Pat. No. 5,148,346, issued Sep. 15, 1992 to Naab et al., and also subject to assignment to the current assignee and incorporated herein by reference, describes another EMI protected, water-actuated pressurized gas release device. The EMI protected, water-actuated pressurized gas release device is constructed with a skirt that overlaps the interface between the circuit casing and the associated primer casing. The skirt serves to block or overlap the interface between the casings to reduce the possibility of EMI radiation passing along the interface to the electric circuitry. The passage between the battery bore and the electronics cavity is also provided with an EMI filter that is electrically connected between the electronic lead wire and the circuit casing with at least one capacitor to shunt EMI radiation leaking into the circuit casing to ground. These improvements provide the device with a high level of EMI protection in accordance with current government standards.

These devices all work well for their intended purposes. However, there is a need for a low cost, lightweight, unobtrusive water-actuated pressurized gas release device for general commercial and individual recreational use. The device needs to automatically inflate an associated personal flotation device should the person ever be subjected to a potentially life-threatening drowning situation, and also needs to be easy to wear and unobtrusive. This ensures that the pressurized gas release device will be worn at all times and therefore available should the person ever become submerged in water. In addition, the device needs to be reliable but inexpensive to manufacture so that it can be sold as a low-cost, non-reusable water-actuated pressurized gas release device.

The water-actuated, pressurized gas release device of the present invention fits all standard inflatable life vests, life jackets, and life rafts, and can be adapted to connect to several different types of pressurized gas cartridges or containers. This makes the device particularly useful to people working on off-shore drilling rigs, on work boats, and in shipyards, as well as to people engaged in construction activities around water, commercial fishing, recreational boating and racing activities and even children, handicapped people or elderly people engaged in activities on or near water. Furthermore, the pressurized gas release device can be manually actuated by a lever connected to the device. In this case, the device can be reused after replacing the pressurized gas container and the flotation device.

OBJECTS OF THE PRESENT INVENTION

It is therefore an object of the present invention to provide a low cost, compact, lightweight, durable water-actuated, pressurized gas release device that automatically actuates to inflate an associated personal flotation device when the pressurized gas release device is immersed in an electrically conductive fluid, such as fresh or salt water.

Further, it is an object of the present invention to provide the foregoing in a water-actuated, pressurized gas release device that is unobtrusive and easily worn by a person engaged in water-related activities so that the device is instantly available to inflate an associated personal flotation device should the person become involved in a potentially life-threatening drowning situation.

Furthermore, it is an object of the present invention to provide the foregoing in a water-actuated, pressurized gas release device that can be manually actuated should the person wearing the device or a helper so desire.

These and other objects will become increasingly apparent by reference to the following description and to the drawings.

IN THE DRAWINGS

FIG. 1 is a view, partly in side elevation and partly in longitudinal section, of a presently preferred embodiment of the water-actuated, pressurized gas release device 10 of the present invention with the cover 126 (FIG. 4) removed and showing the electrical circuit means 87 connected to the primer 68 for firing a piercing pin 44 into a puncturable member 32 of a gas container 30.

Figure 1:
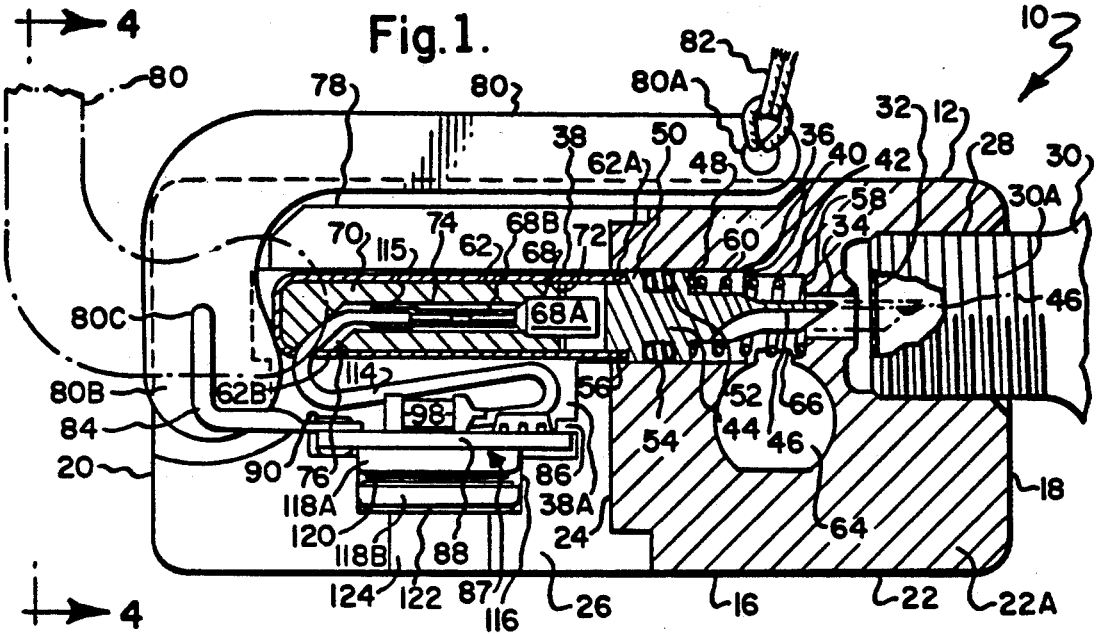
Figure 2:
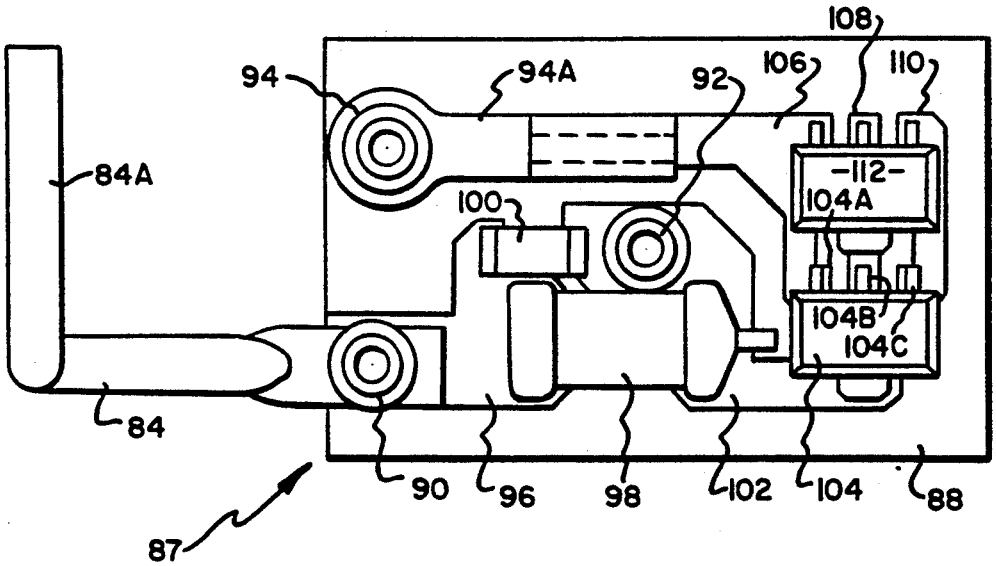
FIG. 2 is a plan view of the electrical circuit board means.
Figure 3:
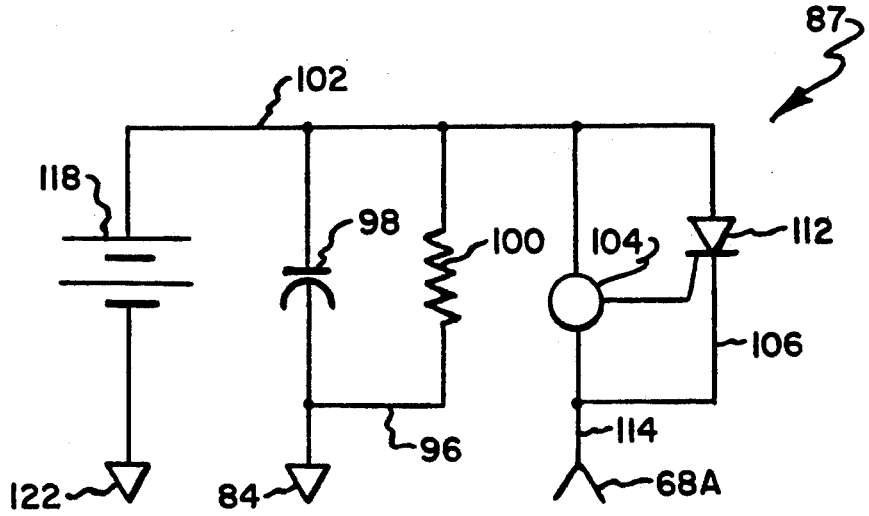
FIG. 3 is a schematic view of the electrical circuit means.
Figure 4:
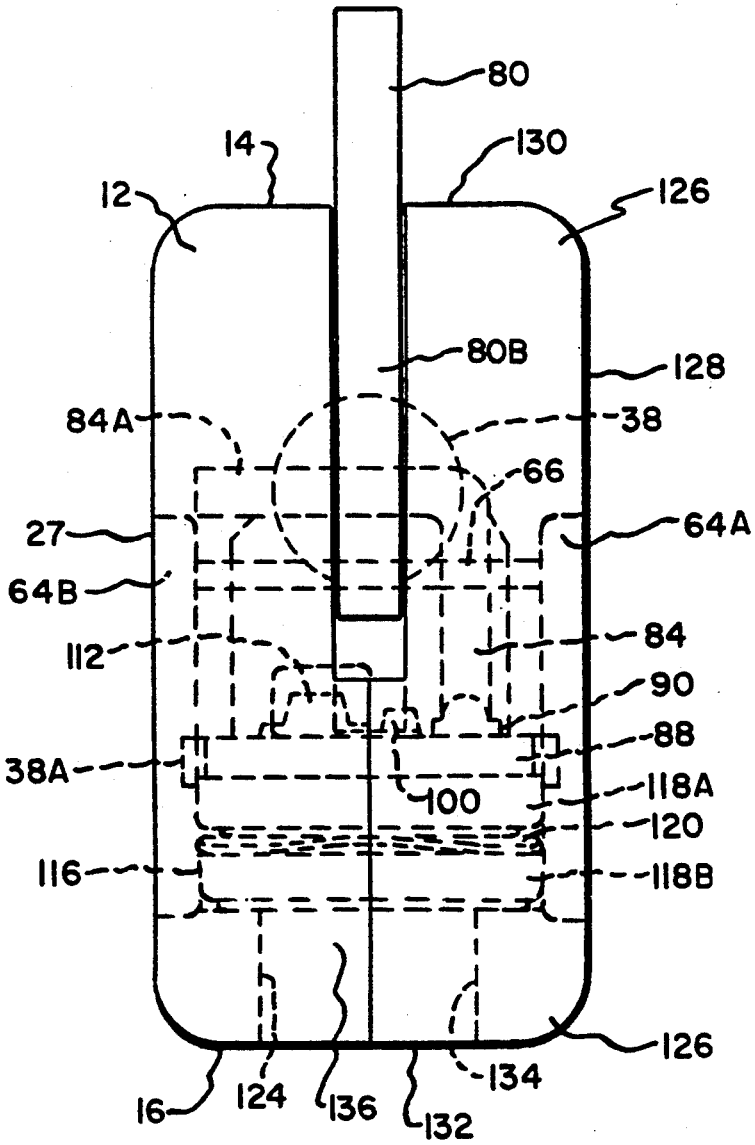

FIG. 4 is a left end, elevational view of the pressurized gas release device 10 shown in FIG. 1 with the cover 126 mounted on the housing 12.

SPECIFIC DESCRIPTION

FIGS. 1 to 4 show a presently preferred embodiment of the water-actuated, pressurized gas release device 10 of the present invention. As particularly shown in FIG. 1, the device 10 is comprised of a valve housing body 12 having an upper side 14, a lower side 16 and spaced apart right and left sides 18 and 20 providing the housing 12 with a generally rectangular cross-section. Housing 12 is formed of a high strength plastic material and has an enlarged right-end section 22 with a front face 22A that extends part of the way from the right side 18 toward left side 20 terminating in an end wall 24, the left-end section of housing 12 defining an inner face 26 between end wall 24 and left side 20. A back face 27 (FIG. 4) extends the length of housing 12 from the right side 18 to the left side 20. The terms upper, lower, right, left, front and back simply refer to the orientation of FIGS. 1 and 4, and are not intended to be limiting.

Extending from the right side 18 and longitudinally into the enlarged section 22 of housing 12 is a cylindrically shaped receiving bore 28 which is threaded to receive the neck of a pressurized gas container 30 having mating threads 30A. The gas container 30 is of a conventional type and contains a volume of pressurized gas, as is well known to those skilled in the art. The pressurized gas is released from the container 30 through a puncturable closure member 32.

A cylindrical through bore 34 of a lesser diameter extends longitudinally between bore 28 and a cylindrically shaped piercing pin bore 36, in axial alignment therewith. The piercing pin bore 36 extends to the end wall 24 of the enlarged section 22. Piercing pin bore 36 has a diameter somewhat between that of the receiving bore 28 and the through bore 34, and leads to a primer cavity 38 formed in the face 26 of the housing 12.

As shown in FIG. 1, piercing pin bore 36 has a shoulder 40 that provides a restricted diameter section 42 adjacent the through bore 34. Piercing pin bore 36 receives and houses a piercing pin 44 having a lance end 46 that extends into the through bore 34, adjacent the puncturable member 32 when the piercing pin 44 is in the rest position, as shown. Lance 46 leads to a shoulder 48 of an intermediate, enlarged section 50 having a radial groove 52 that carries an O-ring 54 in sealing engagement between the piercing pin 44 and the piercing pin bore 36, both at rest and when the piercing pin 44 moves axially along the piercing pin bore 36, as will be hereinafter described in detail. The end of the piercing pin 44 remote from lance 46 is stepped to a male extension 56. A drawn steel, hollow cylindrical primer enclosure tube 62 has an open end 62A fitted over and secured to extension 56, enclosure 62 being closed at its opposite end.

A coil spring 60 extends between the abutment 58 and the shoulder 48 of the piercing pin 44. Spring 60 serves to bias piercing pin 44 and lance 46 away from the puncturable member 32 of the gas container 30 when the piercing pin 44 is in the rest position, as shown in FIG. 1. A transverse, D-shaped opening 64 extends through the enlarged right-end section 22 of housing 12 from the front face 22A to the back face 27 with opposed countersink portions 64A and 64B in the respective faces (FIG. 4). The D-shaped opening 64 is in gas flow communication with the piercing pin bore 36 by means of a keyway 66, as is well known to those skilled in the art, and provides for pressurized gas passage to a life vest, a life jacket, a life raft, or other inflatable flotation device (not shown) that is inflated when the pressurized gas is released from the gas container 30, as will be further discussed hereinafter.

The primer cavity 38 serves to house the enclosure 62, which in turn houses a primer charge 68. Primer 68 is of a conventional type and has a firing head 68A extending from a primer lead 68B. Primer 68 is mounted inside the enclosure 62 along the longitudinal axis of the piercing pin bore 36 by a solid cylindrical insulator 70 of Nylon or other suitable electric and electro-magnetic insulating material, with part of the firing head 68A extending beyond the insulator 70, but spaced from the open end 62A. A push-on retainer 72 is mounted over the firing head 68A and seats against the insulator 70 to hold the primer 68 in place. The insulator 70 is provided with a longitudinal passage 74 having an enlarged outer end which receives primer head 68A. Passage 74 extends part way along the length of enclosure 62 to an angled channel 76 that extends away from the axis of the enclosure 62 to a sidewall opening 62B in enclosure 62.

Housing 12 is further provided with a generally L-shaped recess 78 that extends along the upper side 14 from approximately the middle of the enlarged end section 22 to and downwardly part way along the left side 20. An L-shaped cam lever 80, made of a suitable metal material, fits within recess 78 and has an opening 80A in the outer end of the long leg of lever 80 for connection to a lanyard 82 that in turn connects to a handle (not shown). The short leg of lever 80 has an enlarged rounded cam end 80B provided with a pivot opening 80C that is aligned with an opening (not shown) in the housing 12. A lead wire 84 of solid steel or other suitably strong, electrically conductive material is formed to provide a pivot arm 84A extending through lever opening 80C and the housing opening to serve as a pivot axis to pivot lever 80 from a rest position as shown in FIG. 1, to an actuated position (shown in dashed lines) for manually camming the enlarged end 80B of lever 80 against the closed end of enclosure 62.

This in turn axially moves enclosure 62 and the piercing pin 44 along the longitudinal axis of the piercing pin bore 36 to thrust the lance 46 into the puncturable member 32 for releasing gas from the gas container 30. Lever 80 and lead wire 84 also serve as an electrical return for the pressurized gas release device 10, as will hereinafter be described in detail.

Below the enclosure 62, the primer cavity 38 opens into a circuit board cavity 38A having a ledge 86 formed on its longitudinal inner end wall that provides for mounting an electrical circuit board means 87. The electrical circuit board means 87 is shown in plan view detail in FIG. 2 and schematically in FIG. 3 and comprises a generally rectangular circuit board 88 made of an electrically insulating substrate material. The circuit board 88 supports three terminals 90, 92, and 94 arranged in spaced apart relationship. Terminal 90 is connected to lead wire 84 which extends from the circuit board 88 and provides the pivot arm for lever 80, as previously described. Terminal 90 is connected by a first electrically conductive layer 96 to a capacitor 98 and to a resistor 100 which are mounted in parallel and are in turn connected to a second electrically conductive layer 102. The layers 96 and 102 are formed on the circuit board substrate 88 in a conventional manner. Layer 102 is connected to the second electrical terminal 92 and to a voltage detector 104 which has three terminals 104A, 104B and 104C that are connected to a respective number of electrically conductive layers 106, 108 and 110 formed on the circuit board 88. The conductive layers 106, 108 and 110 are connected to a SCR member 112 and layer 106 is in turn connected to the third electrical terminal 94. The electrical circuit board means 87 is then covered with a conformal coating as is well known to those skilled in the art. This coating prevents the circuit board 87 from short circuiting for a limited period of time when the device 10 is immersed into an electrically conductive fluid, as will be further described.

A connector 94A extends from terminal 94, and is secured to electrical lead 114 that extends through the opening 62B in enclosure 62, and through the passages 76 and 74 in the insulator 70 and connects to a primer socket 115 that is electrically connected to the primer lead 68B.

Circuit board cavity 38A opens into a battery compartment 116 that houses a battery pack comprised of a pair of disc-shaped single-cell batteries 118A and 118B, which are preferably lithium batteries. Batteries 118A and 118B are electrically connected together by an intermediate resilient wave washer 120 which also biases upper battery 118A into electrical contact with terminal 92 which serves as the battery terminal on the circuit board 88. Lower battery 118B has a terminal 122 (shown schematically in FIG. 3) that is spaced from the housing 12 and is centrally positioned over a semi-circular recess 124 that leads through the bottom side 16 of housing 12 from the battery compartment 116. Therefore, when the housing 12 is immersed in an electrically conductive fluid, such as water, whether it is fresh or salt water, an electrical circuit is formed between the terminal 122 of the lower battery 118B and the lever 80 which is connected through the lead wire 84 to the electrical circuit means 87 by the first terminal 90 and serves as an electrical return.

As shown in FIG. 4, a cover 126 is removably mounted on housing 12. Cover 126 is made of a similarly high strength plastic material as housing 12 and has a right side 128 and upper and lower sides 130 and 132 that meet with the upper and lower sides 14 and 16 of housing 12. Cover 126 is glued or epoxyed in place and is further shaped to provide a closure for the primer cavity 38, circuit board cavity 38A and battery compartment 116. Cover 126 also has a semi-circular recess 134 through its lower side 132 that complements recess 124 to provide an opening 136 into battery compartment 116.

IN USE

The water-actuated, pressurized gas release device 10 can be attached to a person's belt or the like by a suitable means, such as a clip or similar device (not shown). A deflated personal flotation device (not shown) such as a life vest, life jacket or a life raft is then attached to the D-shaped opening 64 in a position ready to be inflated when the device 10 is actuated. The device 10 is thus available to help save the person from drowning by inflating the personal flotation device.

To manually actuate the device 10, a user pulls on the handle (not shown) attached to the lanyard 82. This moves lever 80 on pivot arm 84A into the actuated position (shown by dashed lines in FIG. 1), which causes the enlarged end 80B of lever 80 to cam against the closed end of enclosure 62 to force the latter against the bias of spring 60 and move the piercing pin 44 until the shoulder 48 of the piercing pin 44 abuts shoulder 40 formed by the wall of piercing pin bore 36. In the course of such movement, the lance 46 is thrust through the puncturable member 32 (as shown in dashed lines in FIG. 1) to release the pressurized gas held in container 30. The gas passes through bore 34 into section 42 of the piercing pin bore 36 and then into the D-shaped opening 64 to inflate the attached personal flotation device. When the lever 80 is returned to its rest position, biasing spring 60 acts to bias piercing pin 44 and enclosure 62 back into the rest position, as shown in FIG. 1, so that the device 10 can be reused after a fresh pressurized gas container 30 is mounted in receiving bore 28.

In the automatic mode, the device 10 must be immersed in an electrically conductive fluid, such as salt or fresh water in order to actuate. The water closes an electrical circuit between terminal 122 of the lower battery 118B, the lever 80, and lead wire 84 to the electrical circuit means 87. This completes an electric circuit across capacitor 98, to charge the latter. It also imposes a voltage across detector 104. Capacitor 98 charges rapidly, and when the voltage across it, and across detector 104 reaches a predetermined level, SCR 112 is turned on, and capacitor 98 is discharged through SCR 112, conductive layer 106 and electrical lead 114 to fire primer 68A. This occurs before the electrically conductive fluid can flood circuit board cavity 38A and short circuit the electrical circuit means 87 protected by the conformal coating. Capacitor 98 discharges in about one second while electrical circuit means 89 short circuits in about five seconds. When primer 68A fires, piercing pin 44 is driven to the right, against the action of spring 60, causing lance 46 to pierce the gas container closure 32. This releases the gas held in the container 30 to inflate the personal flotation device, as has already been described. When the water-actuated, pressurized gas release device 10 is fired in the automatic mode, the device 10 is not intended to be reused.

It is intended that the foregoing description only be representative of the present invention which is intended to be limited only by the hereinafter appended claims.

What is claimed is:

1. A pressurized gas release device, which comprises:

(a) a housing means including an electrically conductive member and having a receiving bore in coaxial communication with a longitudinally extending piercing pin bore, a transverse opening through the housing means in communication with the piercing pin bore and adjacent the receiving bore, and a first cavity in communication with a second cavity which is in communication with a third cavity;

(b) a container means holding a volume of pressurized gas and having a gas outlet closed by a puncturable member, wherein the container means is removably mounted in the receiving bore with the puncturable member in communication with the piercing pin bore;

(c) a piercing pin means mounted inside the piercing pin bore and longitudinally movable between a rest position and a puncture position in puncturable contact with the puncturable member;

(d) a primer means mounted in the first cavity in longitudinal alignment along the axis with the piercing pin bore and insulated from the electrically conductive member, wherein the primer means is capable of being ignited to move the piercing pin means housed inside the piercing pin bore from the rest position to the puncture position;

(e) an electrical circuit means mounted inside the second cavity in the housing means and operatively associated with the primer means, wherein the electrical circuit means is in electrical contact with the electrically conductive member so that the circuit means is capable of igniting the primer means when the device is immersed into an electrically conductive fluid, the electrical circuit means further having a battery contact; and (f) a battery means mounted inside the third cavity of the housing means with one terminal in electrical contact with the battery contact and an other terminal electrically insulated from the electrically conductive member, wherein the device is immersable in the electrically conductive fluid to establish an electrical path between the other contact of the battery means and the electrically conductive member to actuate the electrical circuit means and thereby fire the primer means to release the pressurized gas from the container means.

2. The pressurized gas release device of claim 1 wherein the first cavity in the housing means provides for mounting an insulating means that provides the insulated relationship between the primer means and the electrically conductive member and that serves to hold the primer means in longitudinal alignment along the piercing pin bore for moving the piercing pin means from the rest position to the puncture position when the electrical circuit means is actuated.

3. The pressurized gas release device of claim 2 wherein the piercing pin means is comprised of a tapered lance means adjacent the puncturable member, a second intermediate portion that is in a sealed relationship with the piercing pin bore and a third portion, spaced from the lance means and wherein the insulating means is comprised of an enclosure means mounted in the first cavity and comprised of a surrounding sidewall closed at one end and open at an opposite end with the primer means mounted inside the enclosure means adjacent the open end by an insulating material provided inside the enclosure means so that when the primer means is ignited, the enclosure means directs propulsion gases that are generated against the piercing pin means which moves longitudinally along the piercing pin bore towards the puncturable material.

4. The pressurized gas release device of claim 3 wherein the third portion of the piercing pin means is provided with an outer annular groove that forms a protrusion and wherein the enclosure means is a cylindrically shaped member comprising an annular sidewall that provides the open end which mates with the protrusion to confine and direct the propuslsion gas generated by the primer means against the piercing pin means.

5. The pressurized gas release device of claim 1 wherein a lever means is pivotably mounted on the housing means and has a cam portion that cams against a motion transition means in motion communication with the piercing pin means when the lever means is manually moved from a lever rest position to an actuated position to thereby cause the motion transition means to move the piercing pin means from the rest position to the puncture position.

6. The pressurized gas release device of claim 1 wherein the first cavity provides for housing an insulating means which is slip-fitted into the first cavity and wherein the insulating means provides the insulated relationship between the primer means and the electrically conductive member, and serves to hold the primer means in longitudinal alignment along the piercing pin bore and wherein the second cavity provides for housing the electrical circuit means which is slip-fitted into the second cavity in the housing means and electrically connected to the electrically conductive member.

7. The pressurized gas release device of claim 6 wherein a lever means is pivotably mounted on a pivot means and has a cam portion that cams against the insulating means when the lever means is manually moved from a lever rest position to an actuated position to cause the insulating means to move axially along the longitudinal axis and against the piercing pin means to move the piercing pin means from the rest position to the puncture position and wherein the electrically conductive member provides the pivot means for the lever means.

8. The pressurized gas release device of claim 7 wherein the electrically conductive member is comprised of an electrical lead that connects between the electrical circuit means and the housing means.

9. The pressurized gas release device of claim 1 wherein the electrical circuit means is provided with a conformal coating that prevents the electrical circuit means from short circuiting until after the primer means is ignited when the device is immersed into the electrical conductive fluid, which fluid floods the first, second and third cavities to provide the electrical path.

10. The pressurized gas release device of claim 10 wherein a cover means is removably mounted on the housing means to close the first, second and third cavities.

11. The pressurized gas release device of claim 10 wherein the cover means is made of an electrically nonconductive material.

12. The pressurized gas release device of claim 1 wherein the piercing pin means is comprised of a tapered lance means adjacent the puncturable member and a second portion that is in a sealed relationship with the piercing pin bore and wherein a shoulder is formed on the piercing pin means between the lance means and the second portion that supports a biasing means in contact with an abutment portion of the piercing pin bore to bias the piercing pin means in the rest position.

13. The pressurized gas release device of claim 12 wherein the piercing pin bore has a cylindrically shaped first diameter and the second portion of the piercing pin means is a cylindrical portion having a second diameter with an annular groove mounting a sealing means to provide the sealed relationship with the piercing pin bore.

14. The pressurized gas release device of claim 13 wherein a passage is provided in the housing means between the receiving bore and the piercing pin bore with the passage having a third diameter, smaller than the first diameter of the piercing pin bore and forming the abutment therebetween with the biasing means comprising a coil spring means having one end contacting the shoulder and another end contacting the abutment to bias the piercing pin means in the rest position.

15. A pressurized gas release device for puncturing a puncturable member closing a gas outlet of a container means holding a volume of pressurized gas for releasing the pressurized gas from the container means, which comprises:

(a) a housing means including an electrically conductive member and having a receiving bore in coaxial communication with a longitudinally extending piercing pin bore, a transverse opening through the housing means in communication with the piercing pin bore and adjacent the receiving bore, and a first cavity in communication with a second cavity which is in communication with a third cavity, wherein the container means is removably mounted in the receiving bore with the puncturable member in communication with the piercing pin bore;

(b) a piercing pin means mounted inside the piercing pin bore and longitudinally movable between a rest position and a puncture position in puncturable contact with the puncturable member;

(c) a primer means mounted in the first cavity in longitudinal alignment along the axis with the piercing pin bore and insulated from the electrically conductive member, wherein the primer means is capable of being ignited to move the piercing pin means housed inside the piercing pin bore from the rest position to the puncture position;

(d) an electrical circuit means mounted inside the second cavity in the housing means and operatively associated with the primer means, wherein the electrical circuit means is in electrical contact with the electrically conductive member so that the circuit means is capable of igniting the primer means when the device is immersed in an electrically conductive fluid, the electrical circuit means further having a battery contact; and (e) a battery means mounted inside the third cavity of the housing means with one terminal in electrical contact with the battery contact and an other terminal electrically insulated from the electrically conductive member, wherein the device is immersable in the electrically conductive fluid to establish an electrical path between the other contact of the battery means and the electrically conductive member to actuate the electrical circuit means and thereby fire the primer means to release the pressurized gas from the container means.

16. The pressurized gas release device of claim 15 wherein the electrical circuit means is provided with a conformal coating that prevents the electrical circuit means from short circuiting until after the primer means is ignited when the device is immersed into the electrical conductive fluid, which fluid floods the first, second and third cavities to provide the electrical path.

17. The pressurized gas release device of claim 15 wherein the first cavity in the housing means provides for mounting an insulating means that provides the insulated relationship between the primer means and the electrically conductive member and that serves to hold the primer means in longitudinal alignment along the piercing pin bore for moving the piercing pin means from the rest position to the puncture position when the electrical circuit means is actuated.

18. The pressurized gas release device of claim 17 wherein the piercing pin means is comprised of a tapered lance means adjacent the puncturable member, a second intermediate portion that is in a sealed relationship with the piercing pin bore and a third portion, spaced from the lance means and wherein the insulating means is comprised of an enclosure means mounted in the first cavity and comprised of a surrounding sidewall closed at one end and open at an opposite end with the primer means mounted inside the enclosure means adjacent the open end by an insulating material provided inside the enclosure means so that when the primer means is ignited, the enclosure means directs propulsion gases that are generated against the piercing pin means which moves longitudinally along the piercing pin bore towards the puncturable material.

19. The pressurized gas release device of claim 18 wherein the third portion of the piercing pin means is provided with an outer annular groove that forms a protrusion and wherein the enclosure means is a cylindrically shaped member comprising an annular sidewall that provides the open end which mates with the protrusion to confine and direct the propuslsion gas generated by the primer means against the piercing pin means.

20. The pressurized gas release device of claim 15 wherein a lever means is pivotably mounted on the housing means and has a cam portion that cams against a motion transmission means in motion communication with the piercing pin means when the lever means is manually moved from a lever rest position to an actuated position to thereby cause the motion transmission means to move the piercing pin means from the rest position to the puncture position.

21. The pressurized gas release device of claim 15 wherein the first cavity provides for housing an insulating means which is slip-fitted into the first cavity and wherein the insulating means provides the insulated relationship between the primer means and the electrically conductive member, and serves to hold the primer means in longitudinal alignment along the piercing pin bore and wherein the second cavity provides for housing the electrical circuit means which is slip-fitted into the second cavity in the housing means and electrically connected to the electrically conductive member.

22. The pressurized gas release device of claim 21 wherein a lever means is pivotably mounted on a pivot means and has a cam portion that cams against the insulating means when the lever means is manually moved from a lever rest position to an actuated position to cause the insulating means to move axially along the longitudinal axis and against the piercing pin means to move the piercing pin means from the rest position to the puncture position and wherein the electrically conductive member provides the pivot means for the lever means.

23. The pressurized gas release device of claim 22 wherein the electrically conductive member is comprised of an electrical lead that connects between the electrical circuit means and the housing means.

* * * * *